US009045308B2

(12) United States Patent
Tamura

(10) Patent No.: US 9,045,308 B2
(45) Date of Patent: Jun. 2, 2015

(54) SHEET PROCESSING APPARATUS AND IMAGE FORMING SYSTEM

(71) Applicant: Naoyuki Tamura, Aichi (JP)

(72) Inventor: Naoyuki Tamura, Aichi (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/692,086

(22) Filed: Dec. 3, 2012

(65) Prior Publication Data

US 2013/0147106 A1 Jun. 13, 2013

(30) Foreign Application Priority Data

Dec. 7, 2011 (JP) ..... 2011-267789
Sep. 28, 2012 (JP) ..... 2012-217620

(51) Int. Cl.
*B65H 37/04* (2006.01)
*B65H 39/00* (2006.01)
*G03G 15/00* (2006.01)

(52) U.S. Cl.
CPC ..... *B65H 39/00* (2013.01); *G03G 15/6547* (2013.01)

(58) Field of Classification Search
CPC ..... B65H 37/04
USPC ..... 270/58.07, 58.08, 58.09, 58.11, 58.16, 270/58.17, 32, 37, 39.08; 493/444, 445
See application file for complete search history.

(56) References Cited

U.S. PATENT DOCUMENTS 7,111,839 B2 * 9/2006 Nishimura ..... 270/58.23
7,185,883 B2 * 3/2007 Kato et al. ..... 270/58.11
7,192,020 B2 * 3/2007 Hayashi et al. ..... 270/58.11
7,354,036 B2 * 4/2008 Hayashi et al. ..... 270/58.12
7,552,917 B2 * 6/2009 Hayashi et al. ..... 270/58.12
8,292,285 B2 * 10/2012 Yokoya et al. ..... 270/58.31
8,511,665 B2 * 8/2013 Iwata et al. ..... 270/58.31
2004/0104525 A1 6/2004 Suzuki et al.
2005/0067777 A1 3/2005 Iida et al.
2005/0104270 A1 5/2005 Nishimura
2006/0022394 A1 2/2006 Tamura et al.
2006/0120783 A1 6/2006 Tokita et al.

(Continued)

FOREIGN PATENT DOCUMENTS

JP 2005-060106 3/2005
JP 2009-286509 12/2009

(Continued)

OTHER PUBLICATIONS

European Search Report dated Apr. 26, 2013.

(Continued)

*Primary Examiner* — Patrick Mackey
(74) *Attorney, Agent, or Firm* — Harness, Dickey & Pierce, P.L.C.

(57) ABSTRACT

A sheet processing apparatus includes an overlap conveying unit that conveys two or more sheets in an overlapping manner; a stacking unit that stacks therein the sheets conveyed in the overlapping manner; an aligning unit that includes a rotating body and a regulating member and is configured to bring the rotating body into contact with a topmost sheet among the stacked sheets, so as to make the sheet abut the regulating member and align ends of the sheets; and a controller that controls the overlap conveying unit. The controller is configured to determine, according to sheet information, whether to make the topmost sheet overlap in a condition of projecting from the other sheets.

6 Claims, 6 Drawing Sheets

(56) References Cited

U.S. PATENT DOCUMENTS

| | | | | |
|---|---|---|---|---|
| 2006/0180999 | A1 | 8/2006 | Suzuki et al. | |
| 2007/0231037 | A1 | 10/2007 | Iida et al. | |
| 2007/0296991 | A1 | 12/2007 | Shimizu et al. | |
| 2008/0019725 | A1 | 1/2008 | Iida et al. | |
| 2008/0179809 | A1 | 7/2008 | Kikkawa et al. | |
| 2010/0225042 | A1* | 9/2010 | Tanaka et al. | 270/58.07 |
| 2011/0285072 | A1* | 11/2011 | Yokoya et al. | 270/58.07 |
| 2013/0032988 | A1* | 2/2013 | Miyake et al. | 270/58.08 |
| 2013/0043636 | A1* | 2/2013 | Gamo | 270/58.07 |
| 2013/0147106 | A1* | 6/2013 | Tamura | 270/58.07 |

FOREIGN PATENT DOCUMENTS

| | | | |
|---|---|---|---|
| JP | 2013001487 | A * | 1/2013 |
| JP | 2013139335 | A * | 7/2013 |

OTHER PUBLICATIONS

Extended European Search Report for corresponding European patent application No. 12194110.8 dated Nov. 7, 2013.

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2011-267789 filed in Japan on Dec. 7, 2011 and Japanese Patent Application No. 2012-217620 filed in Japan on Sep. 28, 2012.

BACKGROUND OF THE INVENTION

1. Field of the Invention

The present invention relates to a sheet processing apparatus and an image forming system, and more particularly, to a sheet processing apparatus that aligns sheet-like recording media such as paper sheets, transfer paper, printing paper, and OHP transparent sheets (in the present specification and claims, referred to as sheets) conveyed thereto, and an image forming system that includes the sheet processing apparatus and an image forming apparatus such as a copying machine, a printer, a facsimile, and a digital multi-function peripheral (MFP) having two functions of the foregoing.

2. Description of the Related Art

In an image forming apparatus such as a laser printer and a color image copying machine using electrophotography, in general, image data input from a personal computer or an image input device is exposed by laser and the like, and an electrostatic latent image is formed on an image carrier such as a photosensitive drum. After the electrostatic latent image is developed with toner by a developing unit, the toner is transferred onto a sheet and is subsequently fused on the sheet by a fixing unit of heating roller type to fix the image onto the sheet, and the sheet is then discharged. In the image forming apparatus, image forming may be performed by, other than electrophotography, using a known image forming engine such as droplet discharge (for example, inkjet) and thermal transfer.

For such an image forming apparatus, provided is a sheet processing apparatus that achieves automation of work by connecting an apparatus that performs post-processing such as alignment, stapling (stitching), punching, sort and collation, binding, and folding. Such a sheet processing apparatus that performs post-processing on sheets on which images are recorded by the image forming apparatus is referred to as a sheet post-processing apparatus as it performs the processing on the sheets after the image forming is performed. In the following description, the sheet processing apparatus is described as a sheet post-processing apparatus.

As a sheet post-processing apparatus of this type, for example, known is the technique disclosed in Japanese Patent Application Laid-open No. 2009-286509. The technique attempts to improve alignment of sheets when feeding the sheets from conveying paths of a plurality of routes into a relay conveying device that temporarily stacks therein the sheets on which images are formed and then discharges the sheets after processing. When a plurality of sheets are made to overlap and are conveyed from a sheet conveying path to an intermediate stacker serving as the relay conveying device, a part of the sheets is made to precede the other part at an initiation stage of conveyance and the sheets are then conveyed while retaining the preceding condition so as to stabilize the preceding amount at all times, thereby improving the alignment at a subsequent processing stage to achieve downsizing of the apparatus.

In the technique disclosed in Japanese Patent Application Laid-open No. 2009-286509, to improve the alignment of sheets when feeding the sheets from the conveying paths of the multiple routes to the relay conveying device, a part of the sheets is made to precede the other parts at an initial stage and the sheets are conveyed while retaining the preceding condition to improve the alignment at a subsequent processing stage. However, the subsequent processing stage is one stage, and it is not contemplated for a plurality of processing stages. In other words, a conventional apparatus that makes sheets overlap assumes a single conveying path, not supporting the conveyance to a plurality of trays. Therefore, while it may be better not to precede the others depending on a destination tray or the type of paper in some cases, the conventional apparatus is not capable of dealing with such cases.

Therefore, there is a need for a sheet processing apparatus and an image forming system capable of improving the alignment of sheets in a tray depending on the tray of a conveying destination or on the type of paper in the tray.

SUMMARY OF THE INVENTION

According to an embodiment, there is provided a sheet processing apparatus that includes an overlap conveying unit that conveys two or more sheets in an overlapping manner; a stacking unit that stacks therein the sheets conveyed in the overlapping manner; an aligning unit that includes a rotating body and a regulating member and is configured to bring the rotating body into contact with a topmost sheet among the stacked sheets, so as to make the sheet abut the regulating member and align ends of the sheets; and a controller that controls the overlap conveying unit. The controller is configured to determine, according to sheet information, whether to make the topmost sheet overlap in a condition of projecting from the other sheets.

According to another embodiment, there is provided a sheet processing apparatus that includes an overlap conveying unit that conveys two or more sheets in an overlapping manner; a first stacking unit that stacks therein the sheets conveyed in the overlapping manner; a second stacking unit that stacks therein the sheets conveyed in the overlapping manner; an aligning unit that aligns ends of the sheets stacked in the second stacking unit; and a controller that controls the overlap conveying unit. The controller is configured to determine, according to which of the first stacking unit or the second stacking unit the sheets are stacked in, whether to make a topmost sheet overlap in a condition of projecting from the other sheets.

According to still another embodiment, a sheet processing apparatus that includes a sheet conveying unit that conveys sheets; a temporary stacking unit that temporarily stacks therein the sheets conveyed by the sheet conveying unit; a delivering unit that delivers a sheet bundle stacked in the temporary stacking unit; a plurality of stacking units that stack therein the sheet bundle delivered by the delivering unit; an aligning unit that aligns the sheets or the sheet bundle stacked in the stacking units in a conveying direction; and a stacking condition setting unit that sets up a stacking condition of the sheets in the temporary stacking unit according to which of the stacking units the sheets are stacked or according to a type of paper.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
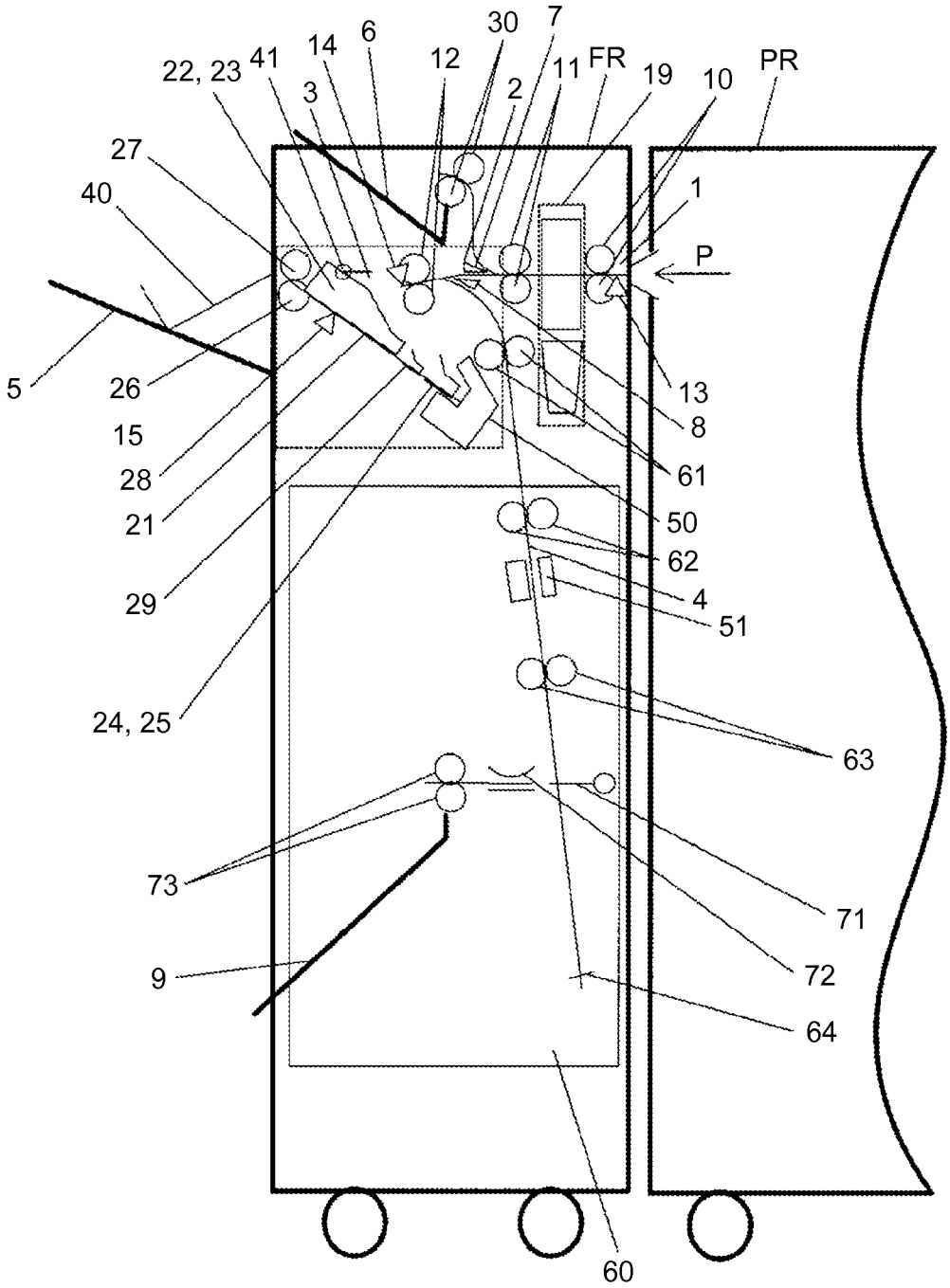
FIG. 1 is a schematic diagram illustrating a configuration of an image forming system composed of an image forming apparatus and a sheet post-processing apparatus according to an embodiment.

In the present invention, when making sheets overlap, a stacking condition of the sheets in a temporary stacking unit is changed depending on a stacking unit of a conveying destination or on the type of paper, and then the sheets are delivered to the stacking unit to align the sheets.

With reference to the accompanying drawings, an embodiment of the invention will be described hereinafter. In the following description, like elements bear like reference numerals or signs and redundant explanations are omitted.

FIG. 1 is a schematic diagram illustrating a configuration of an image forming system composed of an image forming apparatus PR and a sheet post-processing apparatus FR according to an embodiment.

The image forming apparatus PR forms an image on a sheet using an image forming engine and delivers the sheet on which the image is formed to the sheet post-processing apparatus FR. Specifically, the image forming apparatus PR is composed of any one of a copying machine, a printer, a facsimile, and a printing machine having a function to form an image on a sheet, or an MFP combined with the functions of the foregoing apparatuses. The image forming apparatus having those functions is well known and the functions of the image forming apparatus are not a subject matter of the present invention, and thus their explanations are omitted here.

The sheet post-processing apparatus FR includes an introducing path 1 that receives a sheet P from the image forming apparatus PR, and three paths trifurcated from the introducing path 1, more specifically, an upper conveying path 2 leading to a proof tray 6, a straight conveying path 3 in which a shift process and side-stitching and two-point stapling processes are performed, and a lower conveying path 4 in which saddle-stitching and folding processes are performed.

In the introducing path 1, entrance rollers 10 and an entrance sensor 13 are disposed. The entrance sensor 13 detects that the sheet P is introduced into the sheet post-processing apparatus FR. At the downstream of the entrance rollers 10, disposed is a sheet punching unit 19 that punches punching holes in the sheet P in response to a command from the image forming apparatus PR. At the downstream of the sheet punching unit 19, disposed are first carriage rollers 11 through which the sheet P is conveyed to the upper conveying path 2 and is then discharged to the proof tray 6 from upper discharging rollers 30. A first bifurcating claw 7 positioned at a bifurcating portion at an end portion of the introducing path 1 sorts a conveying direction of the sheet, by the switching operation thereof, to the upper conveying path 2 or to the straight conveying path 3. A second bifurcating claw 8, which will be described later, is used when conveying the sheet to the lower conveying path 4.

On the most downstream side of the straight conveying path 3, disposed is a pair of second carriage rollers 12 by which the sheet P is conveyed to a staple tray 21 and a discharge tray 5. In the straight conveying path 3, a pair of ejecting rollers 26 and 27 driven in forward-reverse direction by a driving motor and a drive mechanism not depicted, and a discharge sensor 28 are disposed. When in sort mode, the sheet P is shifted by a constant amount by causing the pair of second carriage rollers 12 having a shift mechanism to move by a constant amount using a driving motor and a drive mechanism not depicted in a direction perpendicular to the conveying direction while the sheet P is conveyed, and the sheet P is then discharged to the discharge tray 5 by the pair of ejecting rollers 26 and 27 to be sequentially stacked in the discharge tray 5.

The pair of ejecting rollers 26 and 27 is provided at a discharging port portion of the staple tray 21 to the discharge tray 5, and the ejecting roller 26 on drive side and the driven ejecting roller 27 constituting the pair are structured to clamp and discharge the sheet P or a sheet bundle PB. In this pair structure, operation of a discharging guide provided with the driven ejecting roller 27 contacting with and separating from the ejecting roller 26 selectively assumes a closed state in which the sheet P or the sheet bundle PB can be clamped and discharged, and an open state in which the sheet P or the sheet bundle PB is not clamped. After the shift operation of the sheet P is completed, the pair structure clamps the sheet P and exerts conveying force to discharge the sheet P.

A feeler 40 is provided near the upper part of the discharging port. The base side of the feeler 40 is supported to swing so that the leading end thereof contacts the top surface near the central position of the sheet P or the sheet bundle PB stacked. Near the base of the feeler 40, provided is a not depicted top surface detecting sensor that detects the height position of the leading end of the feeler 40. By detecting the position of the base of the feeler 40, the height of plane of the sheet P stacked is detected.

When the top surface detecting sensor turns on as the height of sheets rises by an increase in number of sheets stacked on the discharge tray 5, a CPU (controller) FR1 of the sheet post-processing apparatus FR illustrated in FIG. 5 described later performs drive control of a not depicted driving motor that moves the discharge tray 5 up and down to make the discharge tray 5 descend. When the discharge tray 5 descends and the top surface detecting sensor turns off, the CPU_FR1 stops the descent. This operation is repeated, and when the discharge tray 5 reaches a specified full height of the tray, the CPU_FR1 of the sheet post-processing apparatus FR outputs a stop signal to a CPU (controller) of the image forming apparatus PR. The CPU of the image forming apparatus PR then stops the image forming operation based on the stop signal, and further stops the operation of the whole system.

On the most downstream side of the straight conveying path 3, the staple tray 21 is provided. At the position of end of the staple tray 21, disposed is a side-stitching stapler 50 that moves in a direction orthogonal to a sheet conveying direction (sheet width direction) along the trailing ends of sheets and performs binding process. Provided on the top surface of the staple tray 21 are jogger fences 22 and 23 that operate to come close to and move away from each other in a direction orthogonal to the sheet conveying direction as aligning members that perform alignment in the sheet width direction. At the end of the staple tray 21 on the most downstream side, arranged are reference fences 24 and 25 that serve as a reference for alignment of the trailing-ends of sheets. Above the staple tray 21, further provided is a return roller 41 that swings in a pendulum motion to contact and move the sheet P making the trailing end of the sheet P abut the reference fences 24 and 25 so as to align the sheet P in the conveying direction. Furthermore, provided is an ejecting claw 29 that projects upward from the staple tray 21 and moves a stapled sheet bundle in a direction towards the pair of ejecting rollers 26 and 27.

In the sheet post-processing apparatus FR thus configured, the sheet P conveyed to the straight conveying path 3 is discharged onto the staple tray 21, and the position of the sheet in the width direction is aligned by the jogger fences 22 and 23. The trailing end of the sheet is abutted on the reference fences 24 and 25 by the return roller 41, and thus the position of a sheet bundle in a vertical direction is aligned. The sheet bundle PB thus aligned is bound, when in side-stitching mode, at a preset position of a lower edge portion of the sheet bundle PB as the stapler 50 moves in the sheet width direction. The ejecting rollers 26 and 27 then nip the sheet bundle to exert conveying force, and the sheet bundle PB is discharged onto the discharge tray 5.

Provided in the lower conveying path 4 are first to third saddle-stitching carriage rollers 61, 62, and 63, a saddle-stitching stapler 51, a sheet-folding blade 71, a sheet-folding stopper 64, a sheet-folding plate 72, and center-folding discharging rollers 73. The sheet bundle PB, after being aligned in the sheet conveying direction and a direction orthogonal to the sheet conveying direction, for example, in a manner as in a second embodiment described later, is conveyed to a saddle-stitching position at which a binding process is performed at the center of the sheet. The sheet bundle PB is then conveyed by the second and the third saddle-stitching carriage rollers 62 and 63 to the sheet-folding stopper 64 in a sheet-folding unit, is center-folded by the sheet-folding blade 71 and the sheet-folding plate 72, and is ejected by the center-folding discharging rollers 73 to a saddle-stitching discharge tray 9.

When the sheet P is conveyed to the lower conveying path 4, the second bifurcating claw 8 switches after waiting for the sheet P to pass through the straight conveying path 3, for a sheet leading end detecting sensor 14 to detect the leading end of the sheet, and for the trailing end of the sheet to pass over a bifurcating portion of the lower conveying path 4. When the second bifurcating claw 8 switches, the pair of second carriage rollers 12 rotates in reverse to switch over the conveying direction of the sheet P and conveys the sheet P to the lower conveying path 4.

In the embodiment, a saddle-stitching center-folding unit 60 includes the second and the third saddle-stitching carriage rollers 62 and 63, the saddle-stitching stapler 51, the sheet-folding stopper 64, the sheet-folding blade 71, the sheet-folding plate 72, and the center-folding discharging rollers 73.

First Example

A first example is an example in which, when aligning plain paper and performing post-processing thereon, the last sheet is made to overlap preceding sheets in a preceding manner with respect to the preceding sheets, and then the alignment is performed.

Figure 2A:
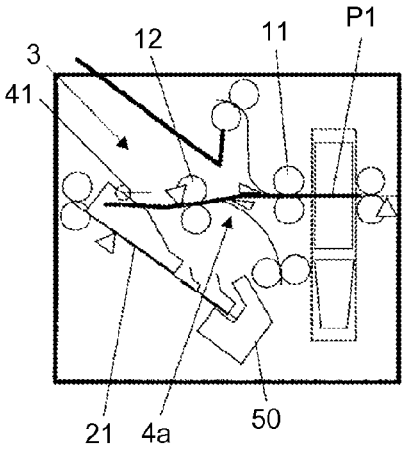
FIGS. 2A to 2D are explanatory diagrams illustrating sheet conveying operation in a first example.

FIGS. 2A to 2D are explanatory diagrams illustrating the sheet conveying operation in the first example. As illustrated in FIG. 2A, a first sheet (preceding sheet) P1 is conveyed from the image forming apparatus PR along the straight conveying path 3, and when the trailing end of the sheet P1 passes over the second bifurcating claw 8, the second bifurcating claw 8 switches as described above. When the second bifurcating claw 8 switches, the pair of second carriage rollers 12 rotates in reverse to switch over the conveying direction of the sheet P1 and conveys the sheet P1 to a position at which the sheet P1 is nipped by at least the first saddle-stitching carriage rollers 61 of the lower conveying path 4. This position is the position of the first sheet (preceding sheet) P1 in FIG. 2B. This is the condition in which the preceding sheet P1 is standing by at a pre-stack portion 4*a* for a following sheet P2 to be conveyed.

Figure 2B:
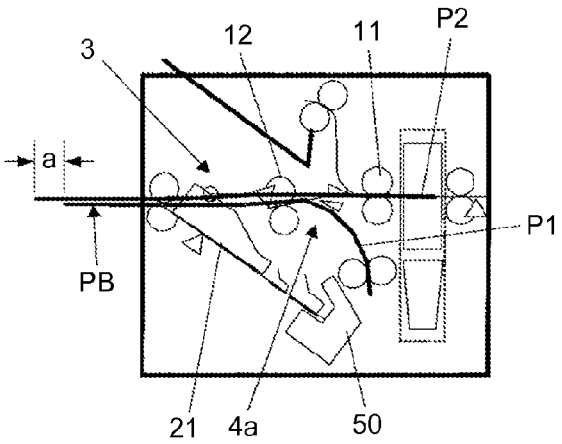

While the first sheet P1 is in a standby condition at the pre-stack portion, a second sheet (following sheet) P2 is conveyed from the image forming apparatus PR side. As illustrated in FIG. 2B, when the second sheet P2 precedes the first sheet P1 by the distance (projecting amount) a, the second sheet is stopped. Accordingly, the first sheet P1 and the second sheet P2 are in an overlapping condition being displaced by the distance a on the downstream side in the sheet conveying direction. Subsequently, the first and the second carriage rollers 11 and 12 rotate while two sheets are in an overlapping condition, and the sheets P1 and P2 are conveyed on the downstream side. The sheets P1 and P2 are ejected to the staple tray 21 at the time the trailing end of the first sheet P1 passes through the nip of the second carriage rollers 12, and the two sheets fall off on the staple tray 21.

Figure 2C:
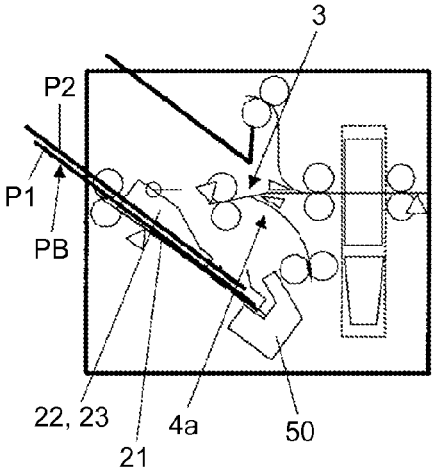
Figure 2D:
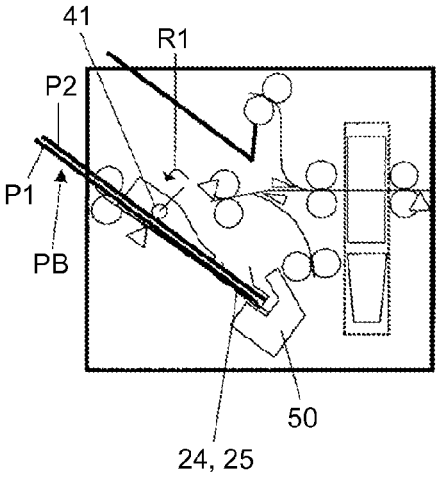

The two fallen sheets P1 and P2 slide towards the reference fences 24 and 25 by the gravity and stop at the position at which the trailing end of the first sheet P1 abuts the reference fences 24 and 25. In this stage, as illustrated in FIG. 2C, the displacement by the distance a remains as is. Accordingly, when the trailing end of the first sheet P1 abuts and stops on the reference fences 24 and 25, the return roller 41 operates (in an arrow R1 direction), and as illustrated in FIG. 2D, contacts the top surface of the second sheet P2 to return the second sheet P2 on the upstream side in the sheet conveying direction. Consequently, the second sheet P2 moves along the top surface of the first sheet P1 towards the reference fences 24 and 25 and abuts thereon, whereby the trailing ends of the two sheets P1 and P2 are aligned by the reference fences 24 and 25. Thereafter, the jogger fences 22 and 23 operate to align the sheets in the direction orthogonal to the conveying direction so as to complete the aligning operation of the sheets in the conveying direction and in the direction orthogonal to the conveying direction.

When the aligning operation of the sheets in the conveying direction and in the direction orthogonal to the conveying direction is completed, the side-stitching stapler 50 binds the ends of the sheets and the ejecting claw 29 ejects the sheets from the staple tray 21 to the discharge tray 5. The binding operation is performed as necessary.

The reason for making the following sheet P2 overlap the preceding sheet P1 such that the leading end of the following sheet P2 projects from the preceding sheet P1 by the distance a is that the sheet P2 on the upper side is the only sheet the return roller 41 can return. Therefore, when aligning three or more sheets on the staple tray 21, the sheets prior to the last sheet are made to overlap and stand by at the pre-stack portion 4*a*. The last sheet is operated in the same manner as the above-described following sheet P2 to be positioned as illustrated in FIG. 2C, and the sheets are then discharged to the staple tray 21 in which the sheets are aligned as illustrated in FIG. 2D.

The pre-stack portion 4*a* is configured at the crossing of the straight conveying path 3 and the upper portion of the lower conveying path 4. When the preceding sheet P1 and the following sheet P2 are made to overlap with each other to be pre-stacked, the preceding sheet P1 is made to stand by at the position of the first sheet (preceding sheet) P1 in FIG. 2B for the following sheet P2 to be conveyed. The following sheet P2, which is the second sheet, is conveyed from the image forming apparatus PR side. Unlike the state in FIG. 2B, the second sheet P2 is stopped in a condition in which the leading end thereof is not displaced (the distance a=0). The two sheets in an overlapping condition are further conveyed, and when the trailing ends of the overlapping two sheets P1 and P2 pass over the second bifurcating claw 8, the second bifurcating claw 8 switches as described above. When the second bifurcating claw 8 switches, the pair of second carriage rollers 12 rotates in reverse to switch over the conveying direction of the two sheets P1 and P2, and conveys the two sheets to a position at which the two sheets are nipped by at least the first saddle-stitching carriage rollers 61 of the lower conveying path 4. This operation is repeated to the last sheet, and the last sheet is stopped in a manner preceding the sheets by the distance a as in the above-described following sheet P2. From this condition, the sheets are aligned as explained with reference to FIGS. 2C and 2D, are bound by the side-stitching stapler 50, and are ejected to the discharge tray 5. Also in this case, the binding operation is performed as necessary.

As described above, in the first example, when discharging sheets to the staple tray 21 and aligning and binding the sheets, the alignment process is performed by the return roller 41, and the last sheet (the topmost sheet) of a sheet bundle is made to overlap the preceding sheets in a preceding manner (with the leading end projecting) with respect to the preceding sheets, whereby the alignment accuracy in the sheet conveying direction can be improved.

Second Example

A second example is an example in which, when aligning sheets and performing post-processing thereon, both ends of the sheets in the conveying direction are aligned at the same time after all of the sheets are made to overlap.

Figure 3A:
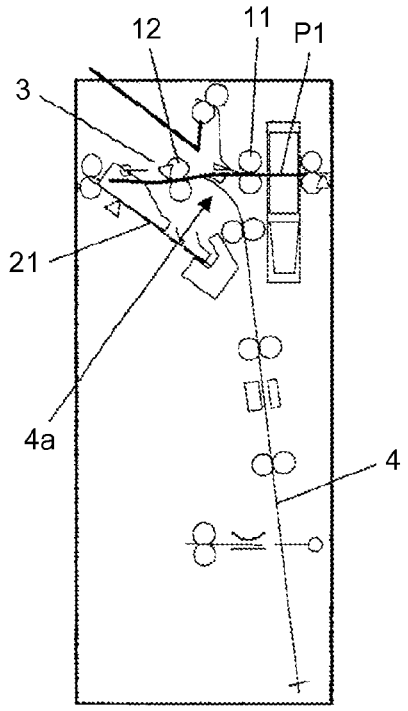
FIGS. 3A to 3D are explanatory diagrams illustrating the sheet conveying operation in a second example.

FIGS. 3A to 3D are explanatory diagrams illustrating the sheet conveying operation in the second example. As illustrated in FIG. 3A, the first sheet (preceding sheet) P1 is conveyed from the image forming apparatus PR along the straight conveying path 3, and when the trailing end of the sheet P1 passes over the second bifurcating claw 8, the second bifurcating claw 8 switches as described above. When the second bifurcating claw 8 switches, the pair of second carriage rollers 12 rotates in reverse to switch over the conveying direction of the sheet P1 and conveys the sheet P1 to a position at which the sheet P1 is nipped by at least the first saddle-stitching carriage rollers 61 of the lower conveying path 4. This position is the position of the first sheet (preceding sheet) P1 in FIG. 3B. This is the condition in which, as in the first example, the preceding sheet P1 is standing by at the pre-stack portion 4*a* for the following sheet P2 to be conveyed.

Figure 3B:
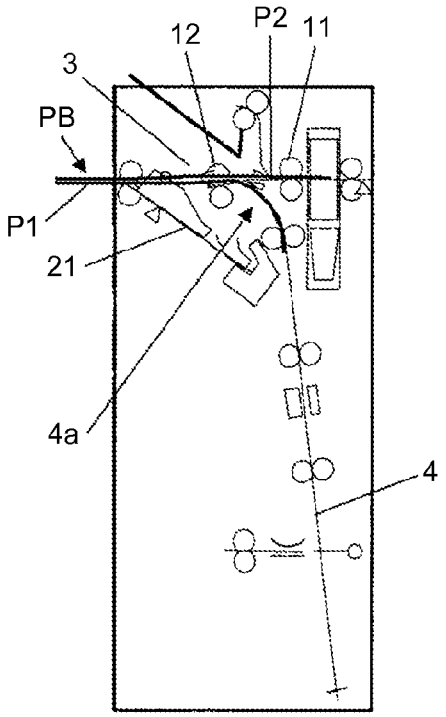
Figure 3C:
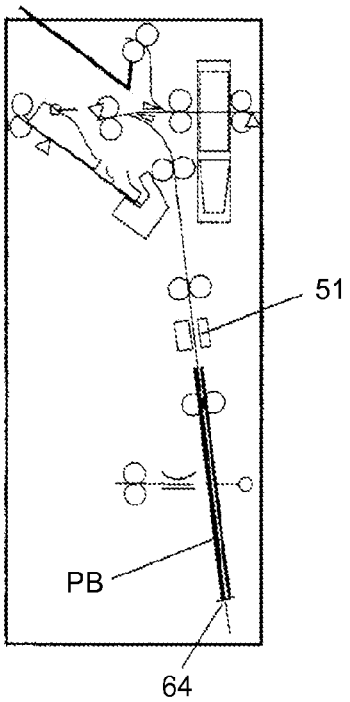
Figure 3D:
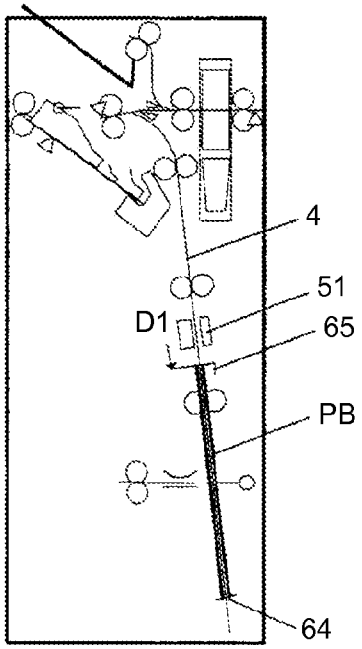

While the first sheet P1 is in a standby condition at the pre-stack portion 4*a*, the second sheet (following sheet) P2 is conveyed from the image forming apparatus PR side. As illustrated in FIG. 3B, at the time the leading end of the second sheet P2 reaches the same position as the leading end of the first sheet P1, the second sheet P2 is stopped. Herein, while the sheet is controlled to stop at the same position under conveying control, it does not matter even though the position is somewhat displaced because the sheets are aligned in a subsequent process. Accordingly, the first sheet P1 and the second sheet P2 form a sheet bundle PB in an overlapping condition. Subsequently, the first and the second carriage rollers 11 and 12 rotate while the two sheets are in an overlapping condition, and convey the sheet bundle PB on the downstream side. When the trailing end of the sheet bundle PB passes over the second bifurcating claw 8, the second bifurcating claw 8 switches as described above. When the second bifurcating claw 8 switches, the pair of second carriage rollers 12 rotates in reverse to switch over the conveying direction of the sheet bundle PB, and conveys the sheet bundle PB in an overlapping condition through the lower conveying path 4 to the lower extent thereof. The trailing end of the sheet bundle PB then abuts the sheet-folding stopper 64 at which the position of each trailing end of the sheets P1 and P2 of the sheet bundle PB is regulated. The sheet-folding stopper 64 is movable in the up-down direction along the lower conveying path 4 by a motor and a driving force transmission mechanism thereof not depicted.

Under this condition, a movable fence 65 retracted from the lower conveying path 4 while the sheets P1 and P2 or the sheet bundle PB is conveyed, moves into the lower conveying path 4. Then, the movable fence 65 is driven by a motor not depicted to press the leading end portion of the sheet bundle PB towards the sheet-folding stopper 64 (in an arrow D1 direction). Consequently, the trailing end portion and the leading end portion of the sheet bundle PB are aligned by the sheet-folding stopper 64 and the movable fence 65, respectively. Provided in the lower conveying path 4 are not depicted jogger fences that align the sheet bundle PB in the direction orthogonal to the sheet conveying direction at the position at which the sheet bundle PB abuts the sheet-folding stopper 64. After the aligning operation in the conveying direction is finished in the lower conveying path 4, the jogger fences then align the sheet bundle PB in the direction orthogonal to the conveying direction.

In the lower conveying path 4, saddle-stitching and center-folding are performed in the saddle-stitching center-folding unit 60. When the sheet bundle PB is aligned in the conveying direction and in the direction orthogonal to the conveying direction, the third saddle-stitching carriage rollers 63 and the second saddle-stitching carriage rollers 62 convey the sheet bundle PB upward so that the central portion of the sheet bundle PB in the conveying direction matches the binding position of the saddle-stitching stapler 51. The saddle-stitching stapler 51 then performs saddle-stitching. The saddle-stitched sheet bundle PB is conveyed by the second and the third saddle-stitching carriage rollers 62 and 63 to a position at which the trailing end of the sheet bundle PB abuts the sheet-folding stopper 64, is center-folded by the sheet-folding blade 71 and the sheet-folding plate 72, and is then ejected by the center-folding discharging rollers 73 to the saddle-stitching discharge tray 9. The sheet-folding stopper 64 is raised from the position indicated in FIG. 3D to a position at which the saddle-stitched staple portion faces the sheet-folding blade 71 before the trailing end of the sheet bundle PB abuts the sheet-folding stopper 64. Accordingly, in the second example, the lower conveying path 4 serves as a saddle-stitching center-folding tray.

As described above, in the second example, because the sheet bundle PB is conveyed to the lower conveying path 4 in an overlapping condition and the trailing end and the leading end of the sheet bundle PB abut the sheet-folding stopper 64 and the movable fence 65 so as to be aligned in the lower conveying path 4, respectively, the alignment accuracy in the sheet conveying direction can be improved. As a consequence, the accuracy in saddle-stitching and center-folding is improved, whereby a clean single-fold booklet can be produced.

Third Example

A third example is an example in which when aligning sheets and performing post-processing thereon, a sheet that lacks in stiffness such that the sheet buckles when return operation is performed by the return roller is processed.

FIG. 4 is an explanatory diagram illustrating the sheet conveying operation in the third example. Although the third example is the same as the first example in terms of using the staple tray 21 to align the sheets, the third example does not use the return roller 41. With a sheet lacking in stiffness, when the return roller 41 is made to contact to return the topmost sheet, the trailing end of the sheet abuts the reference fences 24 and 25, and then the sheet is further conveyed and eventually buckles, thereby making it impossible to align the sheet. Accordingly, in the third example, the following sheet P2 is made to stop at the same position as the preceding sheet P1 by the conveying control performed by the first and the second carriage rollers 11 and 12.

Figure 4A:
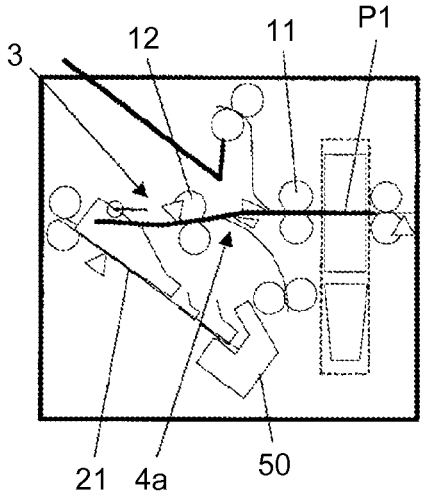
FIGS. 4A to 4D are explanatory diagrams illustrating the sheet conveying operation in a third example.

More specifically, as illustrated in FIG. 4A, the preceding sheet P1 is conveyed from the image forming apparatus PR along the straight conveying path 3, and when the trailing end of the preceding sheet P1 passes over the second bifurcating claw 8, the second bifurcating claw 8 switches as described above. When the second bifurcating claw 8 switches, the pair of second carriage rollers 12 rotates in reverse to switch over the conveying direction of the preceding sheet P1 and conveys the preceding sheet P1 to a position at which the preceding sheet P1 is nipped by at least the first saddle-stitching carriage rollers 61 of the lower conveying path 4. This position is the position of the preceding sheet P1 in FIG. 4B. This is the condition in which the preceding sheet P1 is standing by at the pre-stack portion 4*a* for the following sheet P2 to be conveyed.

Figure 4B:
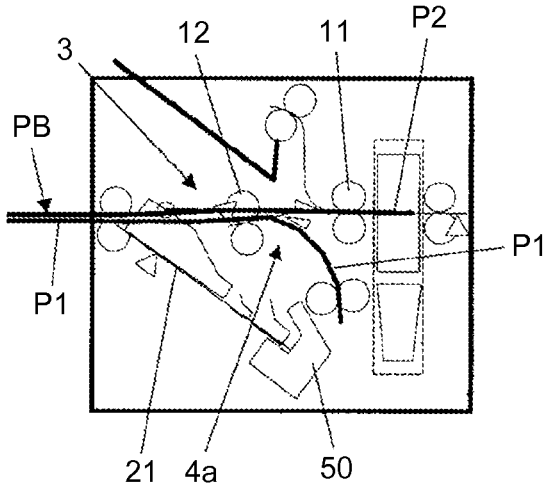
Figure 4C:
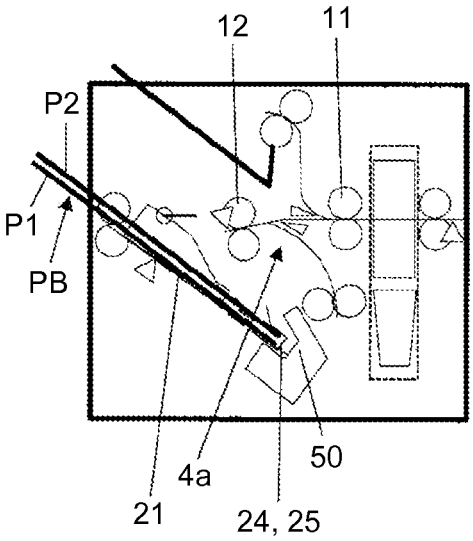
Figure 4D:
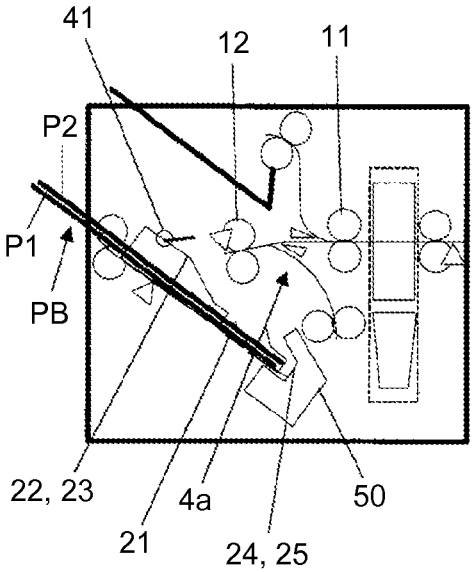

Under this condition, the following sheet P2 that is the second sheet is conveyed from the image forming apparatus PR side, and as illustrated in FIG. 4B, the second sheet P2 is stopped in a condition in which the leading end thereof is not displaced (the distance a=0). Thereafter, the two sheets in an overlapping condition are further conveyed, and as illustrated in FIG. 4C, discharged onto the staple tray 21. The trailing end of the discharged sheet bundle PB falls below by the gravity as illustrated in FIG. 4D and abuts the reference fences 24 and 25, whereby the aligning operation of the trailing end is performed. In other words, for the sheets lacking in stiffness, the return operation by the return roller 41 is not performed, and thus the trailing end of the sheet bundle PB is aligned only by the gravity. Under this condition, the sheet bundle PB is bound by the side-stitching stapler 50, and is then ejected to the discharge tray 5.

When the sheets are three or more, the second sheet P2 is stopped in a condition in which the leading end thereof is not displaced (the distance a=0) as illustrated in FIG. 4B. Thereafter, the two sheets in an overlapping condition are further conveyed, and when the trailing ends of the two overlapping sheets P1 and P2 pass over the second bifurcating claw 8, the second bifurcating claw 8 switches as described above. When the second bifurcating claw 8 switches, the pair of second carriage rollers 12 rotates in reverse to switch over the conveying direction of the two sheets P1 and P2 and conveys the sheets to a position at which the sheets are nipped by at least the first saddle-stitching carriage rollers 61 of the lower conveying path 4. This operation is repeated until the last sheet. The last sheet is stopped in the same manner as the following sheet P2 described above, matching the leading end of the already overlapping sheet bundle PB. From this condition, as illustrated in FIG. 4C, the sheet bundle PB is discharged to the staple tray 21. The trailing end of the discharged sheet bundle PB composed of three or more sheets falls below by the gravity as illustrated in FIG. 4D, and abuts the reference fences 24 and 25, whereby the aligning operation of the trailing end is performed. Thereafter, the sheet bundle PB is aligned by the jogger fences 22 and 23 in the direction orthogonal to the sheet conveying direction.

Subsequently, the sheet bundle PB is bound by the side-stitching stapler 50 and is ejected by the ejecting claw 29 to the discharge tray 5. The binding operation is performed as necessary when the number of sheets is two and when the number of sheets is three or more. When aligning the sheet bundle PB in the direction orthogonal to the sheet conveying direction using the jogger fences 22 and 23, buckling of the sheet bundle PB is never caused because the number of sheets is not one.

As described above, in the third example, when discharging the sheets that lack in stiffness and are easy to buckle to the staple tray 21 and aligning these sheets, the sheets are discharged to the staple tray 21 after the leading ends of the sheets are aligned at the pre-stack portion 4*a* without using the return roller 41, and the trailing ends of the sheets are aligned by the reference fences 24 and 25. This makes it possible to convey sheets after the sheets are aligned even with the sheets that lack in stiffness and are easy to buckle.

The sheet post-processing control including the control of the projecting amount (distance) a of the sheet to precede, the control of setting of the last sheet to project, and others in the first to the third examples is performed by a control circuit of the sheet post-processing apparatus FR. FIG. 5 is a block diagram illustrating the control configuration of the image forming system composed of the sheet post-processing apparatus FR and the image forming apparatus PR. The sheet post-processing apparatus FR includes a control circuit mounted with a microcomputer having a CPU_FR1, an I/O interface FR2, and others. The CPU_FR1 receives a signal from the CPU of the image forming apparatus PR or signals from respective switches and such of an operation panel PR1 and respective sensors not depicted via a communication interface PR2, and the CPU_FR1 performs given control based on the signal received. The CPU_FR1 further controls to drive solenoids and motors via respective drivers and motor drivers, and acquires sensor information of the apparatus from an interface. Moreover, the CPU_FR1 controls to drive motors by motor drivers and acquires sensor information from sensors via the I/O interface FR2 depending on a control subject and a sensor, respectively. As for the control, the CPU_FR1 reads out a program code stored in a not depicted ROM, loads the program code onto a not depicted RAM, and performs the control based on a program defined by the program code while using the RAM as a working area and a data buffer.

Figure 5:
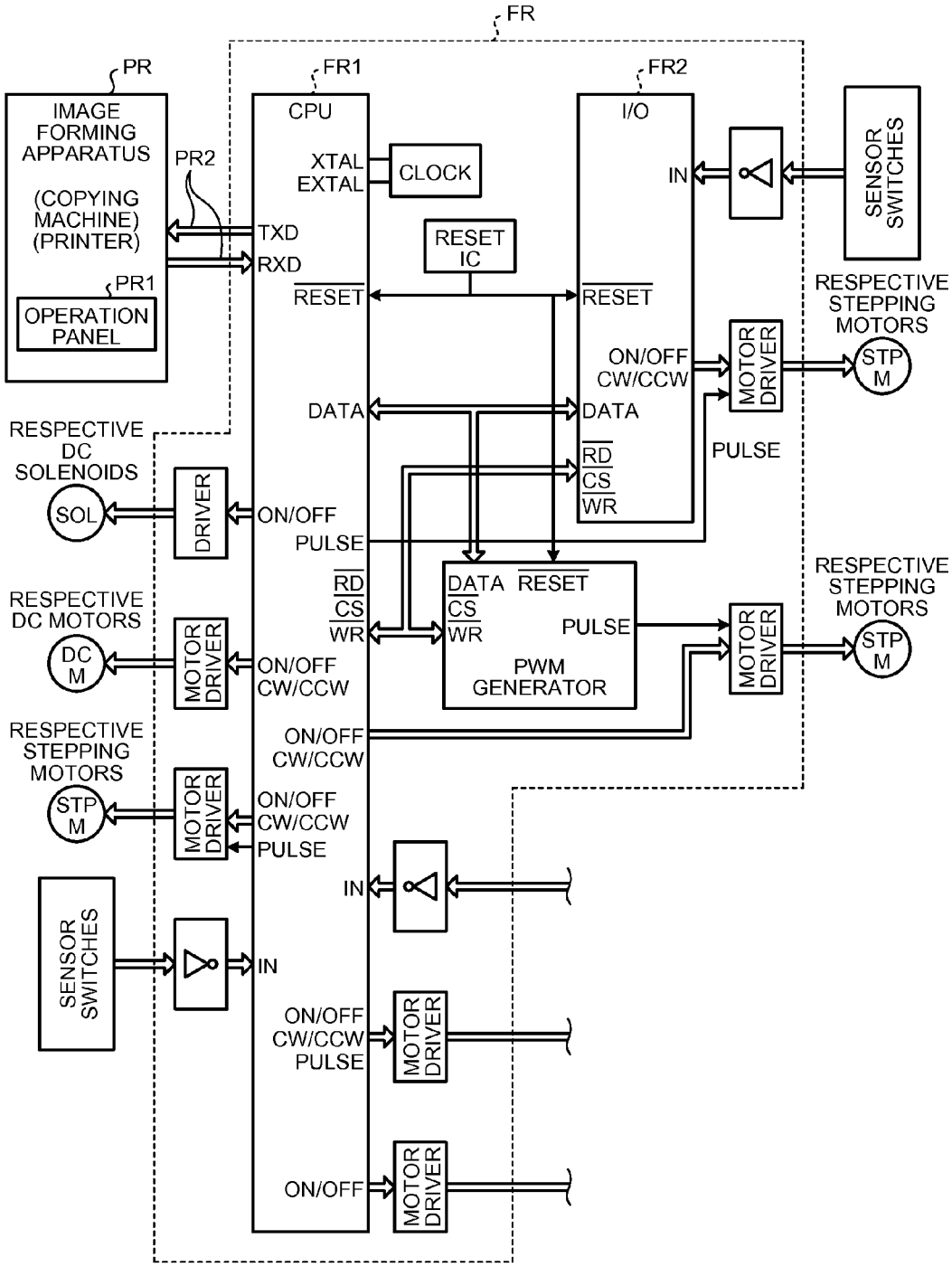
FIG. 5 is a block diagram illustrating a control configuration of the image forming system composed of the sheet post-processing apparatus and the image forming apparatus in the embodiment.

Furthermore, the control of the sheet post-processing apparatus FR in FIG. 5 is performed according to commands or information from the CPU of the image forming apparatus PR. The operational instructions from the user are made through the operation panel PR1 of the image forming apparatus PR. Through the operation panel PR1, for example, the type of paper, i.e., plain paper or thin paper in the embodiment is entered. While plain paper, thin paper, and thick paper are categorized by weight of paper such as ream weight and basis weight, when the user feels a sheet to be thin and liable to buckle, the user may input the paper type as thin paper so that the control in the third example is performed. In the first example, the user may select plain paper and side-stitching, and in the second example, the user may select plain paper and saddle-stitching. In the embodiment, because different control is performed according to whether the sheet causes buckling, if the sheet is plain paper, the user may input the paper type as thick paper. Accordingly, the image forming apparatus PR transmits an operational signal from the operation panel PR1 to the sheet post-processing apparatus FR, and the user is notified of status of processing and functions of the sheet post-processing apparatus FR via the operation panel PR1.

Figure 6:
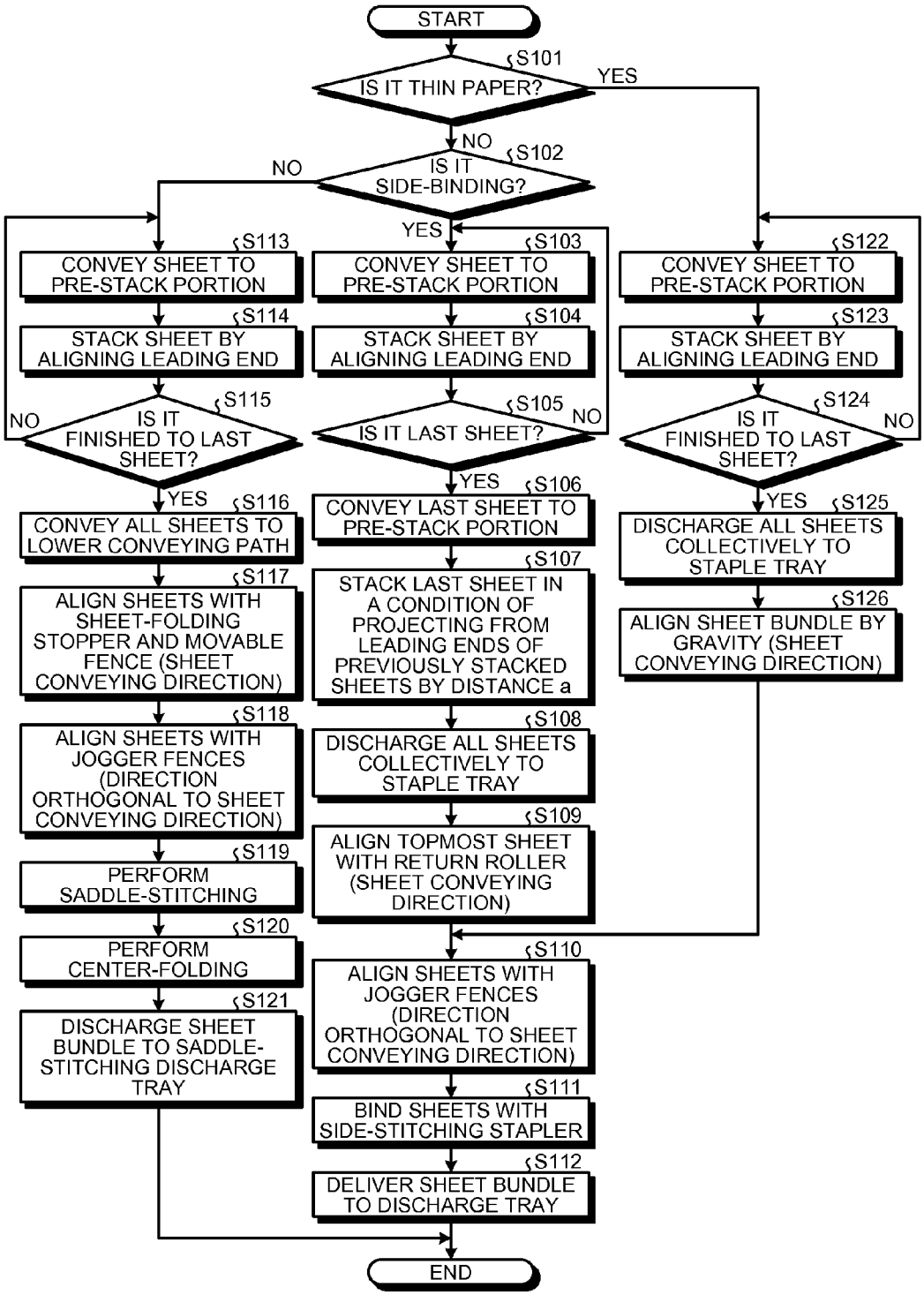
FIG. 6 is a flowchart illustrating a procedure of processes performed in the sheet post-processing apparatus in the embodiment.

FIG. 6 is a flowchart illustrating a procedure of processes performed in the CPU in the embodiment. The procedure includes the processes performed in the first to third examples.

In FIG. 6, determined first is whether it is thin paper (Step S101). Whether it is thin paper is determined by whether a sheet buckles when the sheet is aligned by the return roller 41. It is typically determined based on the operational input made by the user through the operation panel PR1. If it is not thin paper (No at Step S101), determined then is whether it is side-stitching (Step S102). When it is side-stitching, the operation in the first example is performed. More specifically, a sheet is conveyed to the pre-stack portion 4*a* (Step S103), and is pre-stacked by aligning the leading end of the sheet (Step S104). This operation is repeated to one sheet prior to the last sheet (Step S105). The last sheet is stacked in a condition of projecting from the leading ends of the previously stacked sheets by the distance a (Steps S106 and S107).

Next, all of the sheets pre-stacked are discharged collectively to the staple tray 21 (Step S108), the topmost sheet (the last sheet) is conveyed towards the reference fences 24 and 25 side by the return roller 41 to align the sheet in the sheet conveying direction (Step S109). Subsequent to this, the sheets are aligned by the jogger fences 23 and 24 in the direction orthogonal to the sheet conveying direction (Step S110), and after the alignment is completed, the sheets are bound at a given position on the end side by the side-stitching stapler 50 (Step S111). The bound sheet bundle is pushed above the staple tray 21 by the ejecting claw 29, and is ejected to the discharge tray 5 by the pair of ejecting rollers 26 and 27 (Step S112).

On the other hand, when it is not side-stitching at Step S102 (No at Step S102), it is determined as saddle-stitching and the operation in the second example is performed. In the second example, a sheet is conveyed to the pre-stack portion 4*a* (Step S113), and is pre-stacked by aligning the leading end of the sheet (Step S114). This operation is performed until the last sheet is finished (Step S115). Consequently, a sheet bundle the leading ends of which are matched up to the last sheet is formed. All of the sheets are then collectively conveyed to the lower conveying path (the saddle-stitching center-folding tray) 4 (Step S116), and the trailing ends of the sheets are abutted on the sheet-folding stopper 64 while the leading ends thereof are pressed in by the movable fence 65 to align the sheets in the sheet conveying direction (Step S117). Subsequent to this, the sheets are aligned by the jogger fences 23 and 24 in the direction orthogonal to the sheet conveying direction (Step S118). After the alignment is completed, the sheet bundle is pushed up to a saddle-stitching position, and then the saddle-stitching stapler 51 performs saddle-stitching (Step S119), the sheet-folding blade 71 and the sheet-folding plate 72 perform center-folding (Step S120), and the center-folding discharging rollers 73 discharge the sheet bundle to the saddle-stitching discharge tray 9 (Step S121).

Meanwhile, when it is thin paper at Step S101 (Yes at Step S101), the operation in the third example is performed. In the third example, a sheet is conveyed to the pre-stack portion 4*a* (Step S122), and is pre-stacked by aligning the leading end of the sheet (Step S123). This operation is performed until the last sheet is finished (Step S124). Consequently, a sheet bundle the leading ends of which are matched up to the last sheet is formed. All of the sheets are then collectively conveyed to the staple tray 21 (Step S125), and the sheet bundle that slides down by the gravity is aligned by the reference fences 24 and 25 (Step S126). The sheets are then aligned by the jogger fences 23 and 24 in the direction orthogonal to the sheet conveying direction (Step S110), and after the alignment is completed, the sheets are bound at a given position on the end side by the side-stitching stapler 50 (Step S111). The bounded sheet bundle is pushed above the staple tray 21 by the ejecting claw 29, and then ejected to the discharge tray 5 by the pair of ejecting rollers 26 and 27 (Step S112).

As described above, in accordance with the embodiment, the way of overlapping the sheets (amount of overlap) in the pre-stack portion 4*a* at which the sheets are made to overlap is changed depending on a conveying destination (in the embodiment, the staple tray 21 or the lower conveying path 4) or the type of paper, whereby the alignment of sheets can be improved regardless of the conveying destination of sheets or the type of paper.

A sheet in claims corresponds to reference symbols P1 and P2 in the embodiment. Likewise, a sheet bundle corresponds to a reference symbol PB; an overlap conveying unit corresponds to the first carriage rollers 11; a stacking unit corresponds to the staple tray 21; a rotating body corresponds to the return roller 41; a regulating member corresponds to the reference fences 24 and 25; an aligning unit corresponds to the return roller 41 and the reference fences 24 and 25; a controller corresponds to the CPU_FR1; a first stacking unit corresponds to the staple tray 21; a second stacking unit corresponds to the lower conveying path 4; an aligning unit that aligns end portions of sheets stacked in the second stacking unit corresponds to the sheet-folding stopper 64 and the movable fence 65; a sheet conveying unit corresponds to the first carriage rollers 11; a temporary stacking unit corresponds to the pre-stack portion 4*a*; a delivering unit corresponds to the second carriage rollers 12; a plurality of stacking units correspond to the staple tray 21 and the lower conveying path (saddle-stitching center-folding tray) 4; an aligning unit corresponds to the return roller 41 and the reference fences 24 and 25, and the sheet-folding stopper 64 and the movable fence 65; a stacking condition setting unit corresponds to the CPU_FR1; an projecting amount corresponds to the distance a; a first condition corresponds to the condition in FIG. 2B; a second condition corresponds to the conditions in FIGS. 3B and 4B; a sheet processor corresponds to the side-stitching stapler 50, the saddle-stitching stapler 51, the sheet-folding blade 71, the sheet-folding plate 72, the return roller 41, the reference fences 24 and 25, the sheet-folding stopper 64, and the movable fence 65; a sheet processing apparatus corresponds to the sheet post-processing apparatus FR; and an image forming system corresponds to the image forming apparatus PR and the sheet post-processing apparatus FR.

The present invention can improve the alignment of sheets in a stacking unit depending on the stacking unit of a conveying destination or on the type of paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first conveying path;

an overlap conveying unit on the first conveying path that conveys two or more sheets in an overlapping manner;

a second conveying path;

a pre-stack portion on the second conveying path;

a stacking unit that stacks therein the sheets conveyed in the overlapping manner;

an aligning unit that includes a rotating body and a regulating member and is configured to bring the rotating body into contact with a topmost sheet among the stacked sheets, so as to make the sheet abut the regulating member and align ends of the sheets; and a controller that controls the overlap conveying unit, wherein the controller is configured to, according to sheet information, operate the overlap conveying unit in reverse such that a portion of the preceding sheet is moved to the pre-stack portion, and stop the overlap conveying unit when the topmost sheet overlaps the preceding sheet and subsequently start the overlap conveying unit such that the overlapped sheets are conveyed in an overlapping condition.

2. The sheet processing apparatus according to claim 1, wherein the controller is further configured to stop the overlap conveying unit at a position such that the topmost sheet does not project from the preceding sheet when the sheet information indicates that the sheets are thin paper sheets.

3. The sheet processing apparatus according to claim 1, wherein the controller is further configured to stop the overlap conveying unit at a position to make the topmost sheet project from the preceding sheet when the sheet information indicates that the sheets are other than thin paper sheets and when side-binding is performed.

4. The sheet processing apparatus according to claim 1, wherein the controller is further configured to stop the overlap conveying unit at a position to not make the topmost sheet project from the preceding sheet when saddle-stitching is to be performed.

5. An image forming system comprising the sheet processing apparatus according to claim 1.

6. The sheet processing apparatus according to claim 1, wherein the sheet information includes at least one of a weight of a sheet and a destination of the stacked sheets.

* * * * *